US007246419B2

(12) United States Patent
White

(10) Patent No.: US 7,246,419 B2
(45) Date of Patent: Jul. 24, 2007

(54) IMPELLER CLEARANCE TOOL

(75) Inventor: Welton E. White, Mesa, AZ (US)

(73) Assignee: Honeywell International, Inc., Morristown, NJ (US)

( * ) Notice: Subject to any disclaimer, the term of this patent is extended or adjusted under 35 U.S.C. 154(b) by 456 days.

(21) Appl. No.: 10/806,996

(22) Filed: Mar. 22, 2004

(65) Prior Publication Data

US 2007/0130766 A1 Jun. 14, 2007

(51) Int. Cl.
*B21K 3/04* (2006.01)
*B23Q 3/00* (2006.01)
*G01B 5/00* (2006.01)

(52) U.S. Cl. ..... 29/23.51; 29/889.21; 29/464; 33/832

(58) Field of Classification Search ..... 29/889.21, 29/889.6, 889.22, 890.01, 464, 705, 407.1, 29/407.05, 407.09, 23.51; 33/832, 833, 836, 33/203, 203.18, 203.19, 203.2
See application file for complete search history.

(56) References Cited

U.S. PATENT DOCUMENTS 3,872,565 A * 3/1975 Ritz et al. ..... 29/723
3,996,668 A * 12/1976 Sharon ..... 33/701
4,017,979 A 4/1977 Lenz
4,565,013 A 1/1986 Medlock
4,642,900 A 2/1987 Provost et al.
4,744,153 A 5/1988 Brand
4,841,224 A 6/1989 Chalupnik et al.
4,993,165 A 2/1991 French et al.
6,622,397 B1 9/2003 Knoble
2002/0152628 A1* 10/2002 Buckner et al. ..... 33/833
2003/0129894 A1 7/2003 Murakami

* cited by examiner

*Primary Examiner*—David P. Bryant
*Assistant Examiner*—Sarang Afzali
(74) *Attorney, Agent, or Firm*—Ingrassia Fisher & Lorenz

(57) ABSTRACT

A tool and method are provided for providing a predetermined clearance between an impeller and a shroud of a jet engine assembly, wherein the shroud has a mating surface, and the impeller and shroud are partially disposed within a casing having a mating surface, wherein the shroud mating surface and casing mating surface are configured to mate with an inlet housing having corresponding inner and outer mating surfaces with a distance between the planes thereof. The tool comprises a hub having first and second sides and an opening extending therethrough, the first side having first and second mating surfaces configured to mate with the shroud and casing mating surfaces, respectively. The hub has a distance between the planes in which the first and second mating surfaces lie, and the hub distance is less than the distance between the planes in which the inlet housing inner and outer mating surfaces lie.

13 Claims, 5 Drawing Sheets

IMPELLER CLEARANCE TOOL

FIELD OF THE INVENTION

The present invention relates to gas turbine engine repair tools and, more particularly, to a tool for use in providing proper clearance between an impeller and a shroud of a gas turbine engine, such as those found on aircraft and other vehicles.

BACKGROUND OF THE INVENTION

Jet fuel starter engines (also called gas turbine starters) are generally designed and built robustly and safely. Jet fuel starters are generally comprised of multiple components that fit together to comply with certain clearances for optimal engine performance. Additionally, these well-designed engines may need to undergo periodic maintenance and/or repair. Such maintenance and repair operations may include partial or complete disassembly of the engine, and removal, repair, or replacement, of one or more components within the engine. Some of the components may be installed in the engine according to relatively tight tolerances. Although these same components may be manufactured to within design specification tolerances, manufacturing variations may still exist. Thus, engine production and engine re-assembly following maintenance and/or repair may include instances in which these variations are accounted for by using, for example, mechanical shims.

For example, in a jet fuel starter engine, it is desirable that the axial clearance between the compressor impeller and the shroud, which surrounds a portion of the impeller, meets a predetermined desired clearance for efficient impeller operation. When an impeller rotates for a duration of time, kinetic energy from the rotation produces heat. Most preferably, the clearance between the impeller and shroud allows the heat to properly dissipate, which may result in a more efficiently run engine. Conversely, as this axial clearance increases, engine efficiency may decrease. To obtain the appropriate clearance during manufacture or following maintenance or repair, the clearance between the impeller vanes and shroud may be manually positioned, and a measurement gauge may be used to check the clearance between the impeller vanes and the shroud. The impeller and shroud may be manually adjusted and mechanical shims may then be fitted between the shroud and another portion of the engine to obtain the appropriate clearance.

The above-described method of manual positioning, measuring, and adjusting the impeller to the appropriate clearance is generally safe and reliable. However, it may present certain drawbacks. For example, the method by which the impeller is positioned may not be accurate and/or may be time-consuming. Additionally, the method may lack repeatability, thus, the clearance height of each impeller may vary. As a result, the impeller and/or shroud components may be marred or damaged due to improper positioning causing the affected components to be discarded. Moreover, inappropriate positioning may lead to shaft imbalance and improper clearance when the engine is placed back into operation. If there is too little clearance, this decreased clearance may result in less than optimum engine performance and, in some cases, may result in the impeller physically contacting the shroud.

Therefore, there is a need for an apparatus and method that addresses one or more of the above-noted drawbacks. Namely, an apparatus and method that provides accurate readings of the distance between an impeller and shroud so that accurate placement of the impeller within a jet fuel starter engine may be achieved. Moreover, it is desirable to have a tool that assists in the proper adjustment of clearances between the impeller and other components within the engine. The present invention addresses one or more of these needs.

SUMMARY OF THE INVENTION

The present invention provides a tool kit for use in providing a predetermined clearance between an impeller and a shroud each mounted about a central axis of a jet engine assembly, wherein the shroud has a mating surface, and the impeller and at least a portion of the shroud are disposed within a casing having a mating surface, wherein the shroud mating surface and casing mating surface are configured to mate with an inlet housing having corresponding inner and outer mating surfaces, respectively, the inlet housing having a distance between planes in which the inner and outer mating surfaces lie. The tool kit comprises a hub and an adjustment member. The hub has first and second sides and an opening extending therethrough. The first side has first and second mating surfaces configured to mate with the shroud mating surface and the casing mating surface, respectively. Additionally, the hub has a distance between planes in which the first and second mating surfaces lie, wherein the hub distance is less than the inlet housing distance. The adjustment member is configured to couple between the hub first mating surface and shroud mating surface and has a thickness that is substantially equal to the difference between the hub and inlet housing distances.

In another embodiment, and by way of example only, a tool is provided for use in providing a predetermined clearance between an impeller and a shroud each mounted about a central axis of a jet engine assembly, wherein the shroud has a mating surface, and the impeller and at least a portion of the shroud are disposed within a casing having a mating surface, wherein the shroud mating surface and casing mating surface are configured to mate with an inlet housing having corresponding inner and outer mating surfaces, respectively, the inlet housing having a distance between the planes in which the inner and outer mating surfaces lie. The tool comprises a hub having first and second sides and an opening extending therethrough, the first side having first and second mating surfaces configured to mate with the shroud mating surface and the casing mating surface, respectively, the hub having distance between the planes in which the first and second mating surfaces lie, wherein the hub distance is less than the inlet housing distance.

Other independent features and advantages of the preferred tool will become apparent from the following detailed description, taken in conjunction with the accompanying drawings which illustrate, by way of example, the principles of the invention.

DETAILED DESCRIPTION OF A PREFERRED EMBODIMENT

Before proceeding with a detailed description of the various embodiments, it is to be appreciated that the tool described below may be used in conjunction with various types of gas turbine engines, such as small jet engines, that include an impeller, shroud, and diffuser that are coupled about a central rotating shaft. The skilled artisan will appreciate that the below description, when referring to a jet fuel starter engine, encompasses either single shaft or multishaft jet engine architectures. Thus, although the present invention is, for convenience of explanation, depicted and described as being implemented with a jet fuel starter engine, it will be appreciated that it can be implemented with other engine designs.

Figure 1:
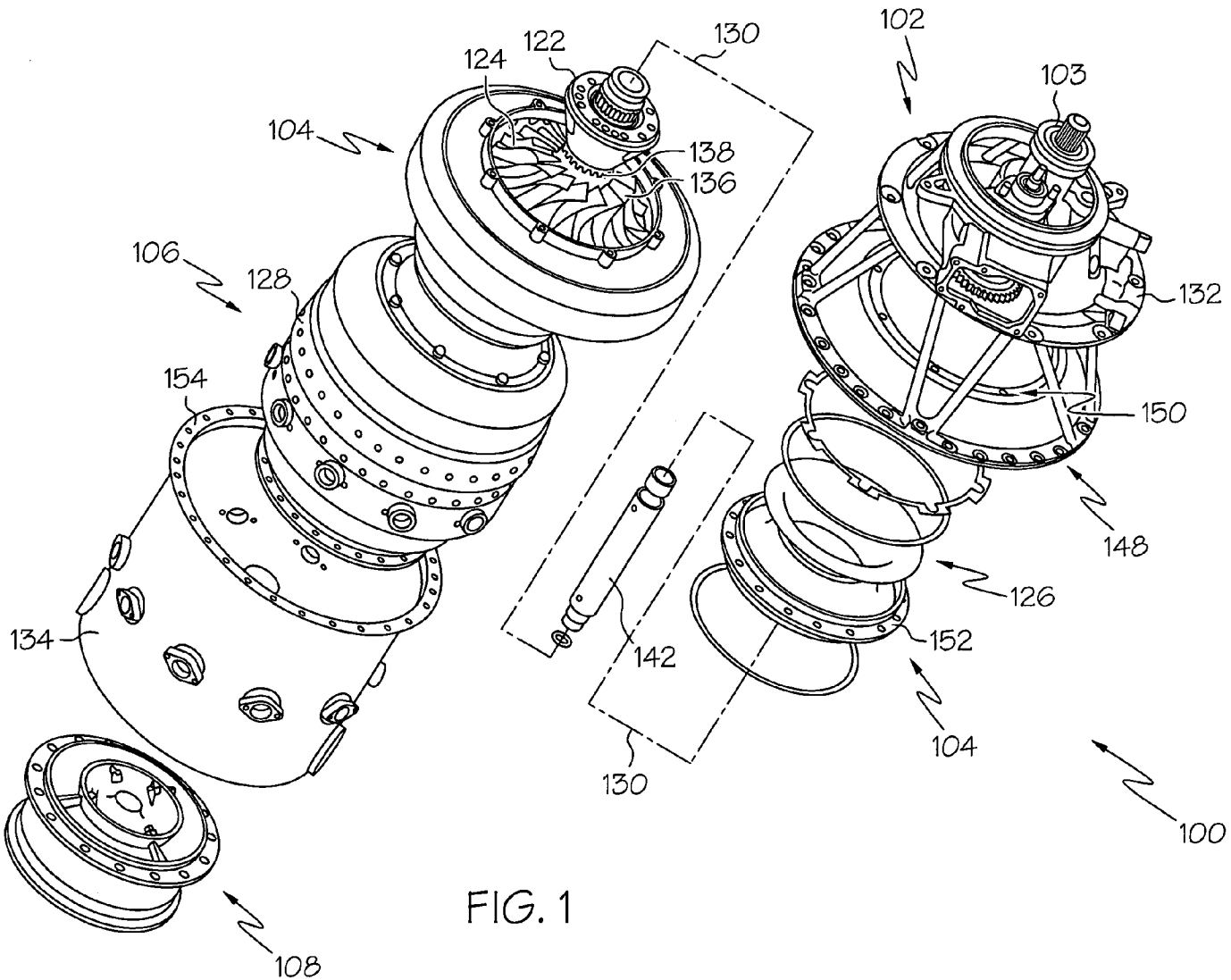
FIG. 1 is an exploded view of another exemplary jet fuel starter on which an exemplary embodiment of the tool may be used.

For the purpose of providing context, a general description of a jet fuel starter engine will now be discussed. With reference first to FIG. 1, an exploded view of a jet fuel starter engine, with which the novel tool 300 may be used, is depicted. As this figure illustrates, a jet engine 100 includes at least four major modules. These major modules include a fan module 102, a compressor module 104, a combustor and turbine module 106 and an exhaust module 108. The modules 102–108 are preferably mounted about a longitudinal central axis 130 around which the components may rotate.

The fan module 102 is positioned at the front, or "inlet" section of the engine 100, and includes a fan (not shown) that induces air from the surrounding environment into the engine 100. The fan module 102 includes at least one gear set 103 that is disposed within an inlet housing 132. The fan module 102 accelerates air drawn from outside of the module into the engine and toward the compressor module 104.

The compressor module 104 accelerates the drawn air at a high speed outward to increase the pressure of the air to a relatively high level. The compressor module 104 includes a seal housing 122, an impeller 124, a shroud 126, and a diffuser 128 which are rotationally mounted about the central axis 130. The seal housing 122 is configured to couple to the fan module 102 and is sized and dimensioned to be disposed within the inlet housing 132. The seal housing 122 is generally constructed to house bearings and gears that couple to the fan module 102. The seal housing 122 is also coupled to the impeller 124.

The impeller 124 has a plurality of vanes 136, a shaft 138, and a longitudinal bore (not shown) that extends throughout. The vanes 136 flare radially outwardly to, consequently, direct air outward. The shaft 138 protrudes outwardly from the flared plurality of vanes 136. The impeller shaft 138 may vary in length, and is configured to engage with a central shaft 142 and aid in mounting the impeller 124 on to the central shaft 142. The central shaft 142 is rotationally supported by bearings (not shown).

The shroud 126 couples to the impeller 124 and flares radially outwardly. The shroud 126 serves to protect the impeller vanes 136 from foreign objects and helps direct the air from the fan module 102 into the impeller 124. The balance during spin rotation of the components that rotate axially around the spin axis of the central shaft 142 and the clearance between the impeller 124 and the shroud 126 are important for optimum engine performance.

Generally, after the high-pressure air travels through the compressor module 104, it then enters the combustor and turbine module 106, where a ring of fuel nozzles (not shown) injects a steady stream of fuel. The injected fuel is ignited by a burner (not shown), which significantly increases the energy of the high-pressure compressed air. This high-energy compressed air then flows through at least one turbine (not shown), causing rotationally mounted turbine blades on each turbine to turn and generate energy. The energy generated in the turbines is used to power other portions of the engine 100, such as the fan module 102 and the compressor module 104. The air exiting the combustor and turbine module 106 then leaves the engine 100 via the exhaust module 108.

The components of the fan, compressor, and combustor modules 102, 104, 106 are at least partially disposed or encased between the inlet housing 132 and a diffuser case 134. The inlet housing 132 includes two mating surfaces 148, 150 that are, in this embodiment, annular. The first or inner mating 148 surface is configured to mount to a corresponding shroud mating surface 152. The second or outer mating surface 150 is configured to mount to a corresponding diffuser case mating surface 154. Once the inlet housing 132, shroud 126, and diffuser case 134 are coupled together, preferably the compressor and combustor module 104, 106 components are held together and in place so that an appropriate clearance is provided between at least the impeller 124 and the shroud 126.

However, as previously mentioned, at times, dimensional variations may exist between the impeller, shroud, diffuser case, and/or inlet housing. Thus, adjustment members, such as, for example, mechanical shims may be placed between two or more of the aforementioned components to make up for the variation and/or provide appropriate clearance between at least the impeller and shroud. This may be particularly applicable in the case where the combustion module 106 is built on top of the exhaust module 108, the compressor module 104 is built on top of the combustion module 106, and the fan module 102 is built on top of the compressor 104. In such case, gravity may act on the components within the modules 102–108 causing undesirable placement and/or lack of appropriate clearance between the components.

Figure 2A:
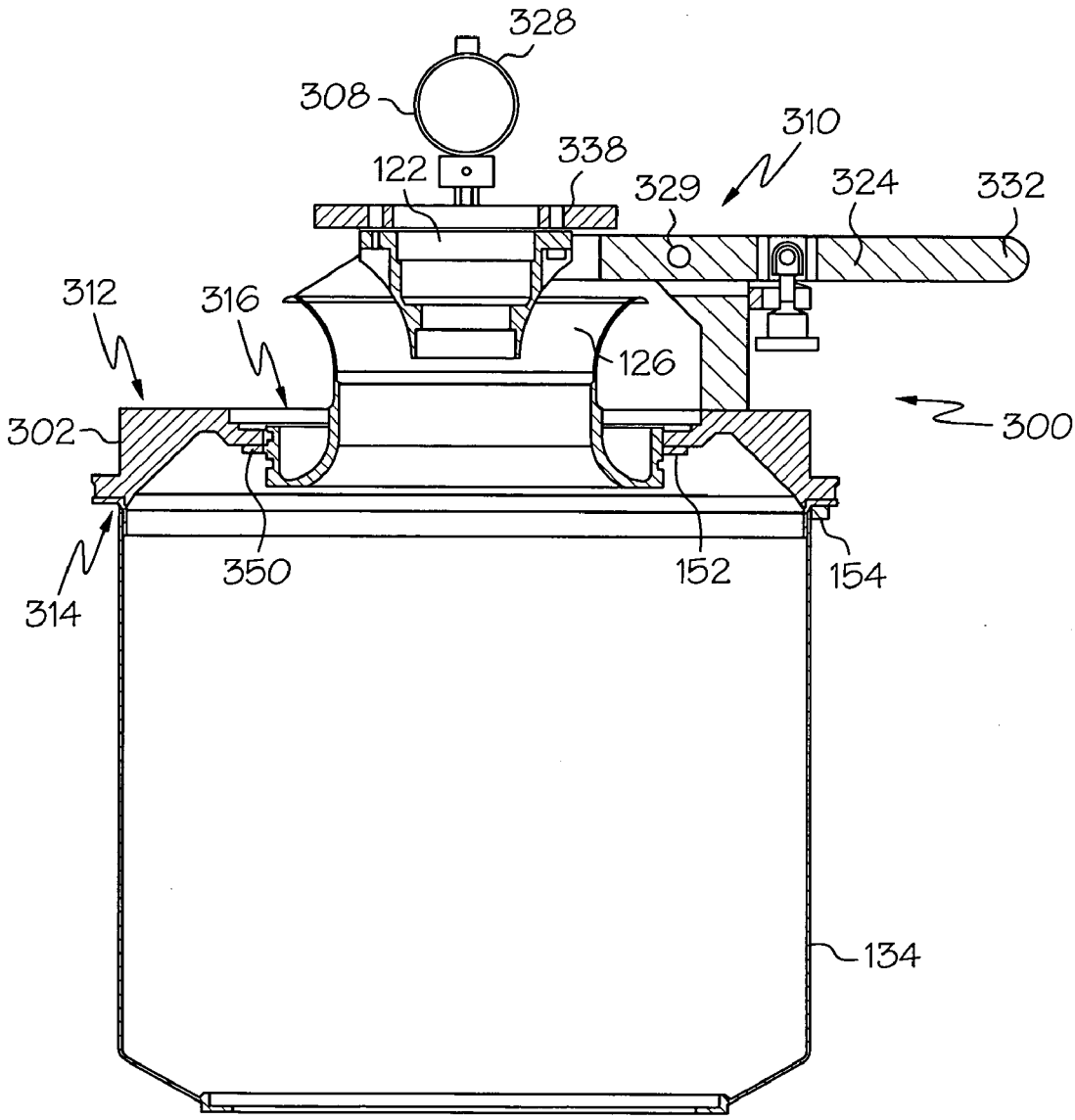
FIG. 2A is a perspective view of the exemplary embodiment of the tool positioned on the exemplary compressor section depicted in FIG. 1.
Figure 2B:
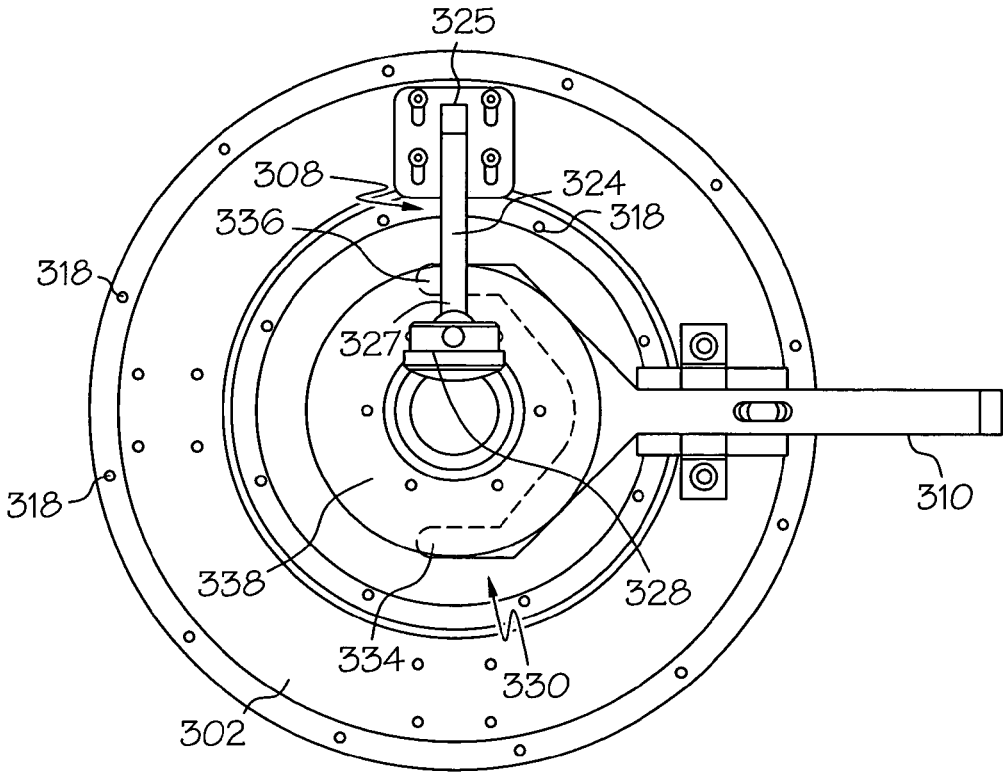
FIG. 2B is a top view of the exemplary tool depicted in FIG. 3A.
Figure 2C:
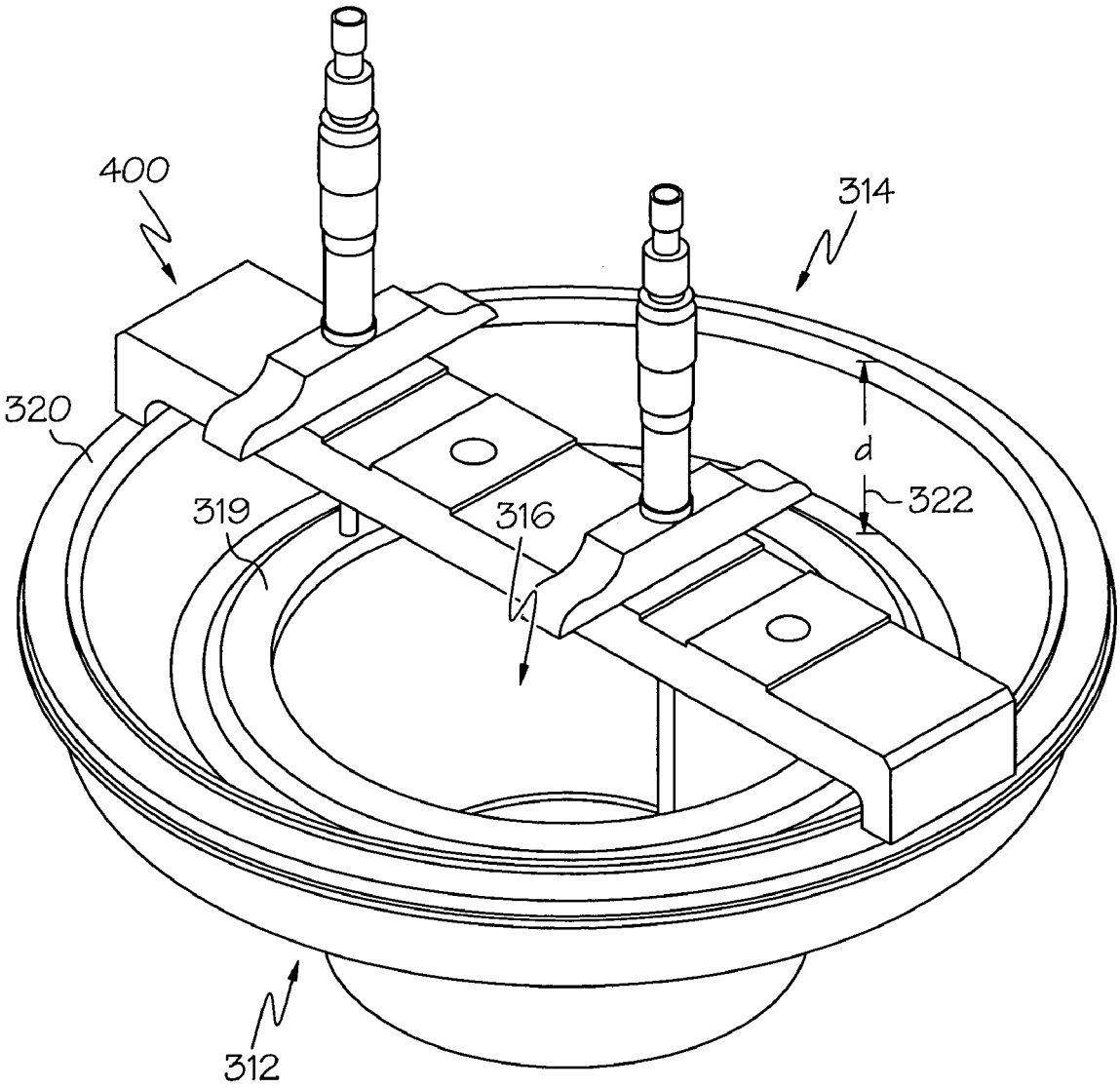
FIG. 2C is a perspective view of the underside of the exemplary tool with an exemplary measurement instrument coupled thereto.

To determine what size shim may be appropriately used, a tool 300, such as shown in FIGS. 2A–2C is preferably employed. The tool 300 is configured to serve as a calibrating device to provide a reference point from which to measure so that the measurements taken can be used to calculate the actual measurements of a compressor module. The tool 300 is preferably a single piece component and includes a hub 302 that can optionally include a measurement instrument 308 and/or an arm 310 that can each be coupled thereto and is preferably used in conjunction with adjustment members 350. The tool 300 can be constructed of any one of numerous materials, such as aluminum or steel.

The hub 302 generally includes a top side 312, a bottom side 314, and an opening 316 formed therebetween. The hub 302 also includes a plurality of fastener bores 318 that are formed therethrough so that the tool 300 can be temporarily fastened to the compressor module 104. The hub 302 is preferably ring-shaped, as depicted in the figures, however, as will be appreciated, can be any one of numerous other shapes, such as, for example, ovular, square, or rectangular. Most preferably, at least a portion of the opening 316 is configured so that at least a portion of the shroud 126 can extend therethrough. As shown in this embodiment, a relatively large opening 316 is provided such that the seal housing 122 and shroud 126 fit through the opening 316.

Referring to FIG. 2C, the hub bottom side 314 includes inner and outer mating surfaces 319, 320 that are concentric to one another and spaced apart such that the inner and outer mating surfaces 319, 320 lie in separate, parallel planes, and inner mating surface 319 substantially aligns with the shroud mating surface 152, and the outer mating surface 320 aligns with the diffuser case mating surface 154 (shown in FIG. 2A). Preferably, the hub 302 is constructed and dimensioned such that the distance 322 between the two planes in which its mating surfaces 319, 320 lie is slightly less than the distance between the two planes within which the inlet housing mating surfaces 148, 150 are located.

Figure 3:
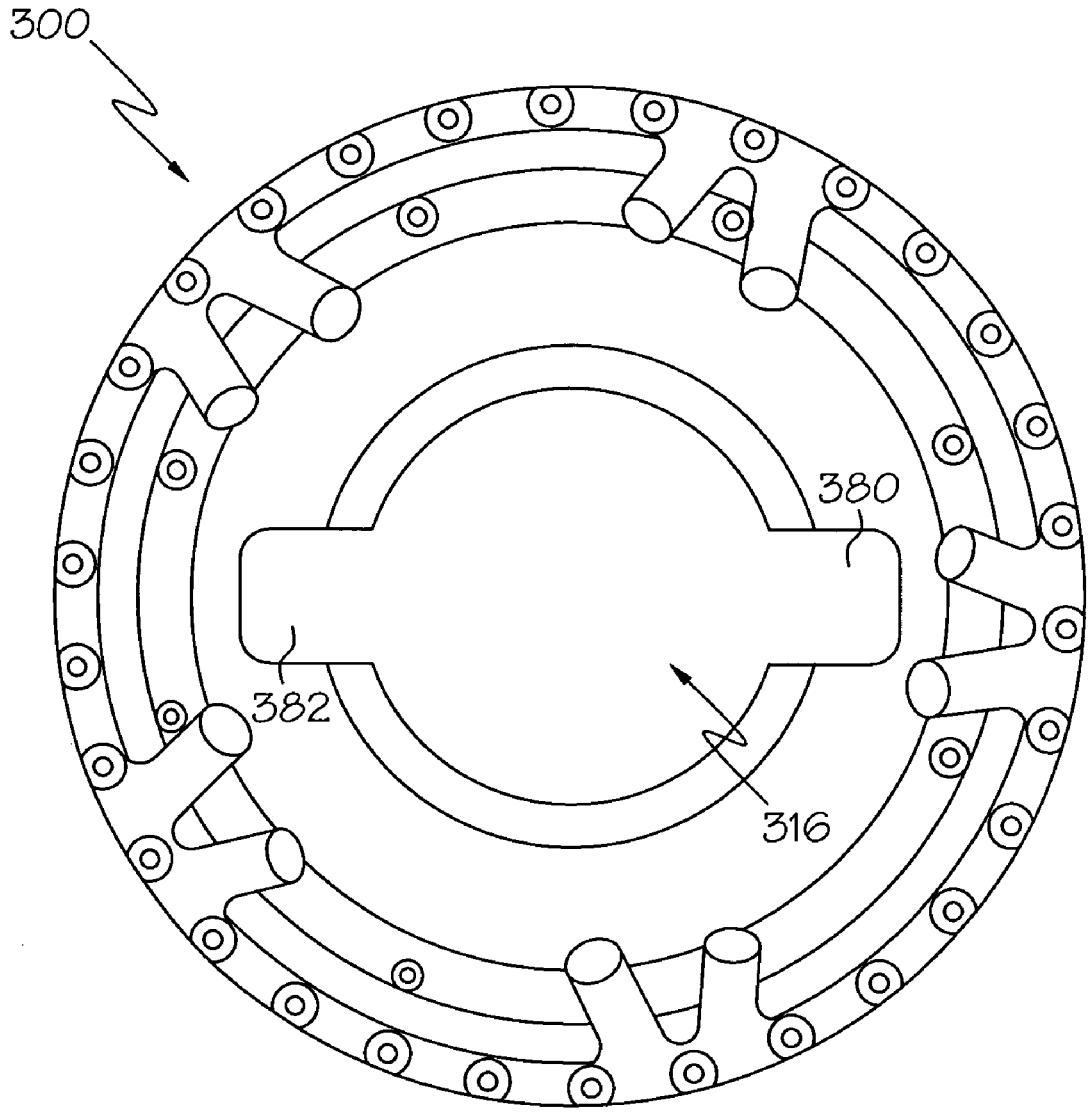
FIG. 3 is a schematic of another embodiment of an exemplary tool.

In one embodiment, such as the embodiment shown in FIGS. 2A and 2B, the hub 302 includes a measurement instrument 308. In this embodiment, the measurement instrument 308 preferably includes an arm 324 that has a first end 325 that mounts the instrument onto the hub 302 and a second end 327 that can include a measuring gauge 328 thereon. Preferably, the measuring gauge 328 is configured such that it can move within a fixed plane to provide drop measurement readings from a point on the plane to a point on the compressor module 104. As will be appreciated, optionally, the measuring gauge 328 can be coupled to, or mounted on, any part of the arm 324. In another embodiment, the measurement instrument 308 is not coupled to the hub 302. Instead, the hub opening 316 is configured to receive a separate measurement instrument 308. As shown in FIG. 3, in such an embodiment, the opening 316 is cut preferably such as to include two cavities 380, 382 that are configured to receive a separate, commercially manufactured measurement instrument that can be mounted on a device that positions the instrument in a plane so that drop measurements can be taken from the plane to at least one point on the compressor module 104.

Returning to FIGS. 2A–2C, the hub 302 can optionally include an arm 310 that is mounted thereto and constructed to act as a lever. The arm 310 includes first and second ends 330, 332 and a mounting point 329, which also serves as a fulcrum. The arm first end 330 preferably includes a pair of lifting arms 334, 336 that are configured to contact the underside of the seal housing 122 so that if an appropriate amount of force is applied to the arm second end 332, the arm first end 330 consequently lifts or lowers the seal housing 122. Alternatively, a separate plate 338 can be employed that is configured to temporarily fastened or mount onto the seal housing 122. Preferably, the plate 338 is constructed so as to provide an increased underside surface area with which the lifting arms 334, 336 can contact.

The adjustment members 350 that are used can be any type of height adjustment element, such as shims. In the case that the tool 300 is provided as a tool kit, the tool kit can include a plurality of differently-sized adjustment members 350, so that any variation in measurements of the impeller, shroud, diffuser case, and inlet housing can be accounted for by using at least one or more of the plurality of differently-sized adjustment members.

An exemplary method of determining the appropriate shims for providing a desired clearance between the impeller and shroud of a jet fuel starter will now be discussed. First, the dimensions of the tool 300 to be used are obtained. Specifically, a calculation is made to obtain the distance between the two planes in which the tool inner and outer mating surfaces 319, 320 are located. This distance can be obtained in any one of numerous fashions, such as, for example, by using a mic bridge 400 to measure the drop measurement from the outer mating surface 320 to the inner mating surface 319, such as shown in FIG. 2C.

Next, an inlet housing 132 selected to mate with the compressor module 104 is obtained. The distance between the two planes in which the inlet housing inner and outer mating surfaces 148, 150 is also obtained. Just as with the tool measurements, the inlet housing 132 measurements can be obtained in numerous fashions, however, most preferably the mic bridge 400 is placed on the inlet housing outer mating surface 150 and a drop measurement is made to a point on the inlet housing inner mating surface 148.

Both the inlet housing distance and tool distance are then compared to one another. The difference between the two distances is used in the selection of appropriately sized adjustment members or shims needed for use in conjunction with the tool 300. The selected adjustment member(s) are placed on the shroud mating surface 152. The tool 300 is then mounted on and coupled to the shroud 126 and diffuser case 134. Coupling the tool 300 and appropriate shims 350 to the compressor module 104 simulates the actual positions in which the components, namely, the impeller, shroud, and diffuser case, will be in upon coupling with the selected inlet housing 132.

Thus, once the tool 300 and adjustment members 350 are coupled to the compressor module 104, actual measurements of the compressor module 104 can be taken. These measurements are then used to determine the dimensions of additional shims needed for providing the appropriate clearance between the impeller 124 and shroud 126. The measurements can be obtained by any one of numerous methods, however, most preferably, the measurements are taken with a measurement instrument, as mentioned previously, that is be mounted on the tool 300 itself. In yet another embodiment, the measurement instrument is separate from the tool 300. As previously discussed, in such case, the tool 300 includes two cavities which are configured to receive the measurement instrument. Any type of conventional measuring instrument, such as, for example, a mic bridge, mic bar with a measurement gauge, may be employed.

Preferably, the measurements taken include drop measurements of points on the impeller and on the seal housing. Drop measurements to the seal housing 122, wherein the seal housing 122 is prevented from having any axial movement is preferably obtained as well. To this end, the seal housing 122 can be manually lifted until it cannot be lifted any further or optionally, if an arm 310 is coupled to the hub 302, such as depicted in one of the embodiments of the tool 300 mentioned above, the arm 310 can be used to lift the seal housing 122. The third drop measurement to the seal housing is then obtained. The collected measurements are then compared to predetermined acceptable measurements. The difference between the collected and predetermined measurements are then used to determine the dimensions of adjustment members to be inserted between the shroud mating surface 152 and inlet housing inner mating surface 148 to provide the desired clearance between the impeller and shroud. As will be appreciated, all of the calculations that need to be obtained can be performed manually or by any type of computer program.

Once all of the desired measurements are collected, the tool 300 is removed from the compressor module 104, and the remainder of the jet fuel starter is constructed.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A tool for use in providing a predetermined clearance between an impeller and a shroud each mounted about a central axis of a jet engine assembly, wherein the shroud has a mating surface, and the impeller and at least a portion of the shroud are disposed within a casing having a mating surface, wherein the shroud mating surface and casing mating surface are configured to mate with an inlet housing having corresponding inner and outer mating surfaces, respectively, the inlet housing having a distance between the planes in which the inner and outer mating surfaces lie, the tool comprising:

a hub having first and second sides, an opening extending therethrough, and a plurality of bores, the first side having first and second mating surfaces configured to mate with the shroud mating surface and the casing mating surface, respectively, the hub having distance between the planes in which the first and second mating surfaces lie, wherein the hub distance is less than the inlet housing distance, and the plurality of bores extending between the hub first and second sides each bore configured to receive a fastener to couple the hub to the jet engine assembly.

2. The tool of claim 1, wherein the jet engine assembly further comprises a seal housing, wherein the shroud is axially coupled to the seal housing, the tool further comprising:

an arm coupled to at least a portion of the hub and configured to contact the seal housing to selectively raise and lower the seal housing away from and toward the shroud, respectively.

3. The tool of claim 2, further comprising:

a plate configured to couple to the seal housing and increase the area with which the arm can contact.

4. The tool of claim 3, wherein the arm further comprises first and second ends, wherein the first end is coupled to the hub and the second end includes two arms configured to contact the plate so that when force is applied to or removed from the first end, the second end raises or lowers the seal housing, respectively.

5. The tool of claim 1, further comprising:

a measuring tool coupled to at least a portion of the hub, the tool configured to provide at least one measurement from a point in a plane proximate the hub to a point on the jet engine assembly.

6. The tool of claim 5 wherein the measuring tool further comprises:

an arm having first and second ends, wherein the first end is coupled to the hub; and a measuring gauge coupled to the arm.

7. The tool of claim 1, wherein the hub is ring-shaped.

8. The tool of claim 1, wherein the hub comprises aluminum.

9. The tool of claim 1, wherein the hub opening is configured to receive a mic bridge.

10. A tool for use in providing a predetermined clearance between an impeller and a shroud each mounted about a central axis of a jet engine assembly, wherein the shroud has a mating surface, and the impeller and at least a portion of the shroud are disposed within a casing having a mating surface, wherein the shroud mating surface and casing mating surface are configured to mate with an inlet housing having corresponding inner and outer mating surfaces, respectively, the inlet housing having a distance between the planes in which the inner and outer mating surfaces lie, the tool comprising:

a hub having first and second sides and an opening extending therethrough, the first side having first and second mating surfaces configured to mate with the shroud mating surface and the casing mating surface, respectively, the hub having distance between the planes in which the first and second mating surfaces lie, wherein the hub distance is less than the inlet housing distance; and a measuring tool coupled to at least a portion of the hub, the tool configured to provide at least one measurement from a point in a plane proximate the hub to a point on the jet engine assembly.

11. The tool of claim 10, wherein the measuring tool further comprises:

an arm having first and second ends, wherein the first end is coupled to the hub; and a measuring gauge coupled to the arm.

12. A tool for use in providing a predetermined clearance between an impeller and a shroud each mounted about a central axis of a jet engine assembly, wherein the shroud has a mating surface, and the impeller and at least a portion of the shroud are disposed within a casing having a mating surface, wherein the shroud mating surface and casing mating surface are configured to mate with an inlet housing having corresponding inner and outer mating surfaces, respectively, the inlet housing having a distance between the planes in which the inner and outer mating surfaces lie, the tool comprising:

a hub having first and second sides and an opening extending therethrough, the first side having first and second mating surfaces configured to mate with the shroud mating surface and the casing mating surface, respectively, the hub having distance between the planes in which the first and second mating surfaces lie, wherein the hub distance is less than the inlet housing distance;

an arm coupled to at least a portion of the hub and configured to contact the seal housing to selectively raise and lower the seal housing away from and toward the shroud, respectively; and a plate configured to couple to the seal housing and increase the area with which the arm can contact.

13. The tool of claim 12, wherein the arm further comprises first and second ends, wherein the first end is coupled to the hub and the second end includes two arms configured to contact the plate so that when force is applied to or removed from the first end, the second end raises or lowers the seal housing, respectively.

* * * * *